United States Patent [19]

Scheurer et al.

[11] Patent Number: 4,547,165

[45] Date of Patent: Oct. 15, 1985

[54] PERSONAL FLOTATION DEVICE

[76] Inventors: Stephen M. Scheurer; Robert S. Scheurer, both of P.O. Drawer 539, Wichita Falls, Tex. 76307

[21] Appl. No.: 460,093

[22] Filed: Jan. 21, 1983

[51] Int. Cl.[4] ..... B63C 9/10

[52] U.S. Cl. ..... 441/112; 441/113; 441/116

[58] Field of Search ..... 441/80, 81, 88, 102, 441/103, 106, 108, 111, 112, 113, 114–119; 428/252, 311.1

[56] References Cited

U.S. PATENT DOCUMENTS

| | | | |
|---|---|---|---|
| 2,950,489 | 8/1960 | Pattison | 441/113 |
| 3,077,618 | 2/1963 | O'Link | 441/113 |
| 3,094,722 | 6/1963 | Lerner | 441/102 |
| 3,867,236 | 2/1975 | O'Link | 441/106 |
| 4,047,255 | 9/1977 | Kiefer | 441/111 |
| 4,167,051 | 9/1979 | Galecke | 441/117 |
| 4,276,341 | 6/1981 | Tanada | 428/252 |

*Primary Examiner*—Trygve M. Blix
*Assistant Examiner*—Stephen P. Avila
*Attorney, Agent, or Firm*—James C. Wray

[57] ABSTRACT

A personal flotation apparatus is made of one or more layers of cross-linked polyethylene polymeric foam material. A nylon or polyester cloth preferably having a tight weave is fused to one or both of the inner or outer surfaces. When more than one layer is used the cloth may be fused to interfaces of both layers. Edge portions of the personal flotation apparatus are rounded inward and cloth fused to the outer surface is extended inward around the round edge to abut or overlap and be joined to cloth on an inner surface.

26 Claims, 14 Drawing Figures

FIG. 1
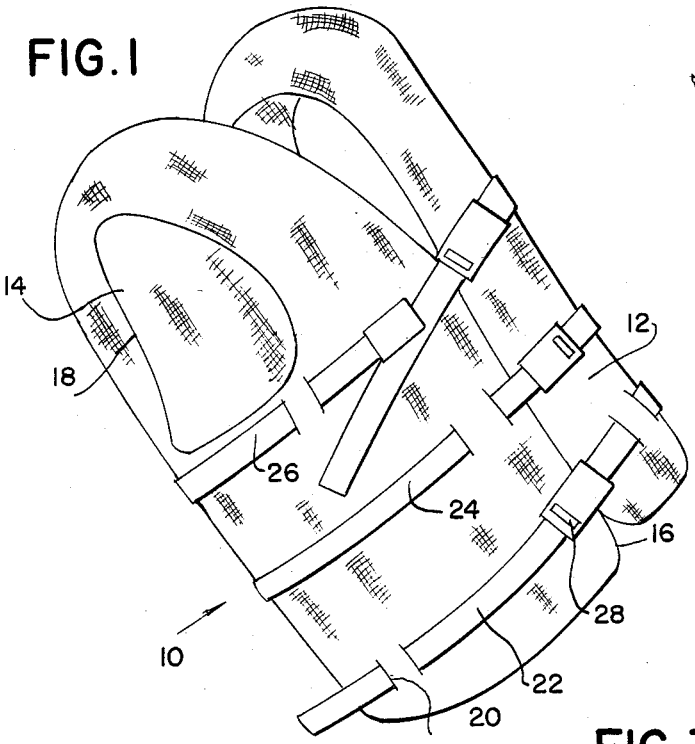
FIG. 3A
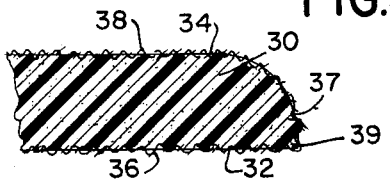
FIG. 3B
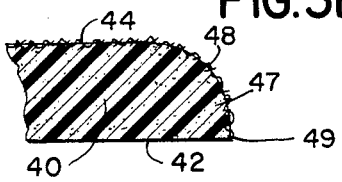
FIG. 3C
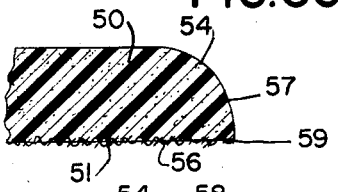
FIG. 3D
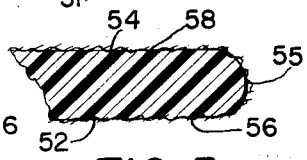
FIG. 5
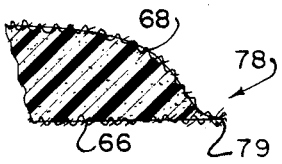
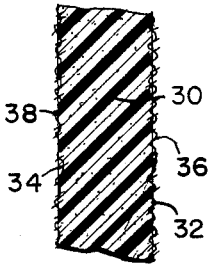
FIG. 2A
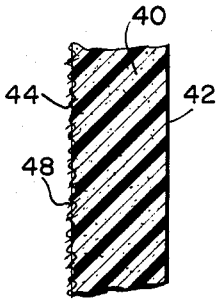
FIG. 2B
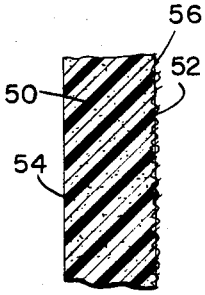
FIG. 2C
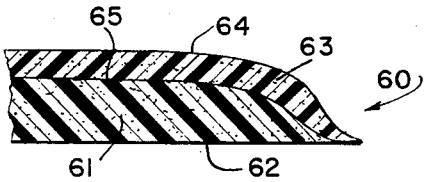
FIG. 4A
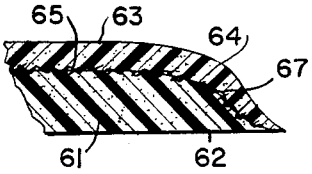
FIG. 4B
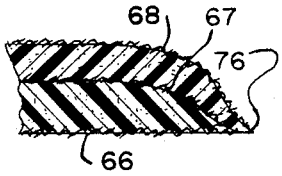
FIG. 4E
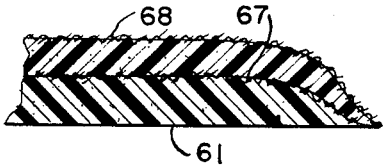
FIG. 4C
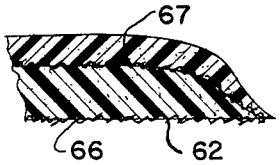
FIG. 4D

PERSONAL FLOTATION DEVICE

BACKGROUND OF THE INVENTION

Personal flotation apparatus have taken many forms. Historically buoyant flotation material has been held in pockets formed in cloth or some other material which holds the buoyant material about the body.

In other personal flotation apparatus buoyant material has been held on the body by straps. Tearing of the cloth pockets or buoyant material may be encountered. It is highly desirable to take advantage maximum available strength of materials.

The present invention takes such advantage of the materials in an unique and unobvious manner.

SUMMARY OF THE INVENTION

The present invention provides a personal flotation apparatus which uses a highly desirable strong, buoyant and deterioration-resistant cross-linked polyethylene. One of the inherent problems of the cross-linked polyethylene is that it does not readily accept surface bonding. Thus if the cross-linked polyethylene material is used as a personal flotation apparatus a difficulty is encountered in holding straps on the device particularly on the high impact situations.

To overcome the problems associated with the use of cross-linked polyethylene and other highly desirable polymeric foam materials, the inventors have designed devices which the straps pass through the actual foam material.

Uniquely, that system may tend to tear the foam material and not take full advantage of the strengths of the strap and buckles under high impact situations.

The inventors have found that the use of a cloth material fused to one or more surfaces of the foam polymeric material provides a highly desirable life vest with the new and unobvious attributes of providing high strength and surface comforts. The inventors have found that it is highly desirable to use stretch polymeric cloth material, particularly knitted and especially tight woven polyester and nylon cloths, and it is particularly desirable to flame fuse those cloths to the surface of the polymeric material, particularly the cross-linked polyethylene foam during manufacture.

Single stretch or double stretch material is preferred for its unique characteristics that it renders to the invention in the form of comfort and flexibility to the wearer and in the providing of highly desired qualities of strength to the final product and of formability to the personal apparatus.

The stretch material is particularly useful in forming edge portions of the personal flotation apparatus.

In preferred embodiments the edge portions are rounded and are preferably formed with a quarter rounded outer surface substantially normally abutting an inner surface. As the apparatus are cut from sheet material of cross-linked polyethylene to which the cloth has been fused, the edge portions of the foam material and cloth are heated and cut to round the outer surfaces at the edge portions thereof and to abut the outer cloth covering with an inner surface or a cloth covering on the inner surface. In one form of the invention it is originally desirable to extend the cloth covering by further substantially compressing the foam material so that the cloth covering can be permanently joined along edges, such as by fusing or sewing.

In the preferred form of the invention a highly desirable life vest is provided by fusing polyester or nylon cloth to inner and outer surfaces of polymeric foam material, particularly cross-linked polyethylene. Desirable products are also obtained by fusing the cloth material to an outer surface of the foam material or by fusing cloth material to an inner surface of the foam material.

The product is improved by rounding edge portions inwardly and bringing the cloth covering on the outer surface into intimate contact with and/or closely spaced from the cloth covering on the inner surfaces.

In one preferred form of the invention the polymeric foam material is constructed of two or more layers and the cloth material is fused to interface surfaces of the layers, fusing the layers and the cloth together. In that embodiment, it is further desirable to fuse cloth to the exposed inner and outer surfaces of the layered foam material. It is highly useful to fuse cloth only to the outer surface of the material and it is also useful to fuse cloth to the inner surface of the material.

As described herein personal flotation apparatus includes flotation vests and belts and other worn articles and flotation devices such as swimming pool floats, kick boards, knee boards and surf board type articles.

BRIEF DESCRIPTION OF THE DRAWINGS

FIG. 1 is a perspective view showing a preferred form of a personal flotation apparatus of the present invention.

FIGS. 2A, 2B, and 2C show preferred forms of cloth material connected intimately over entire surface areas of the polymeric foam material.

FIGS. 3A, B, C and D show edge details of the preferred form of the invention.

FIGS. 4A, 4B, 4C, 4D, and 4E show preferred multiple layer constructions.

FIG. 5 show an alternate edge construction.

DETAILED DESCRIPTION OF THE DRAWINGS

Referring to FIG. 1, a personal flotation apparatus is generally referred to by 10. The personal flotation apparatus shown in the drawing is a vest type apparatus having an outer surface 12, and an inner surface 14 and having edges 16, some of which form arm openings 18. Openings 20 may be provided in the vest to receive straps 22, 24 and 26. Buckles 28 join the straps in conventional well known manner.

As shown in FIG. 2A, in a preferred form of the invention, a cross-linked polyethylene foam 30 has an inner surface 32 and an outer surface 34. A cloth, preferably a polyester or nylon cloth 36 is fused to inner surface 32.

A similar cloth 38 is fused to outer surface 34.

Preferably the cloth is a tightly knitted single or double, one-way or two-way stretch material, so that the foam may be comfortably bent in any direction by stretching the cloth on the convex curvature.

As shown in FIG. 2B, a highly desirable form of the invention is provided with a foam material 40 having an inner surface 42 and outer surface 44 on which a cloth material 48 is fused.

As shown in FIG. 2C, a highly desirable form of the invention is provided by providing a foam 50 of similar construction with an inner surface 52 and an outer surface 54 and a stretch material 56 fused to the inner surface 52.

As shown in FIG. 1, preferred edge areas 16 and armhole areas 18 are formed by rounding the edge portions of the foam and carrying the cloth layer on an outer layer inward to contact and the cloth layer on the inner edge outward to contact each other.

In the double-covered foam material 30 as shown in FIG. 3A, the inner surface 32 and the outer surface 34 have fused thereto respective cloth layers 36 and 38.

The edge portion of the outer surface is compressed inward when cutting to carry the fused cloth portion 37 inward so that an edge of the outer cloth 38 contacts an edge of the inner cloth 36 at edge 39 of the foam.

As shown in FIG. 3B, the foam material 40 has an inner surface 42 and an outer surface 44. A cloth covering preferably polyester or nylon double or single stretch material 48 is fused to the outer surface 44. The outer surface is compressed when cutting so that the edge portion 47 carries the cloth 48 inward to the edge 49 where it joins the inner surface 42.

As shown in FIG. 3C, the foam material 50 has an inner surface 51 and an outer surface 54. The cloth covering 56 is fused to the inner surface 51 of the foam. When the foam material is cut, the terminal portion 57 is compressed and rounded inwardly such as by heat forming so that the terminal portion abuts the inner surface in a substantially normal or perpendicular position.

As shown in FIG. 3D, the foam edge is rounded and cloth coverings 56 and 58 meet at center 55. This is a preferred embodiment.

As shown in FIG. 4A, two layers of diverse or identical foam material 60 may be used. Inner layer 61 has an inner surface 62. Outer layer 63 has an outer surface 64. Layers 61 and 63 have a fused interface 65.

As shown in a more preferred form of the double layer configuration in FIG. 4B, the interface 65 which comprises the inner surface of layer 63 and the outer surface of layer 61 has a double or single stretch polyester or nylon layer 67 fused to both layers 61 and 63, securing the cloth and layers together.

A modification of the apparatus shown in FIG. 4B is shown in FIG. 4C where an additional cloth layer 68 is fused to the outer surface of the outer layer. A further modification of the apparatus shown in FIG. 4B is shown in FIG. 4D wherein the inner surface 62 has a cloth layer 66 bonded thereto in addition to the cloth layer 67 at the interface of the two layers.

Another preferred embodiment is shown in FIG. 4E, the foam is provided with an outer layer 68 fused to the outer surface of the outermost layer of foam and an inner cloth layer 66 fused to the innermost layer of foam as well as an interface cloth layer 67 fused to the inner surface of the outer layer and to the outer surface of the inner layer. The three cloth coverings are mutually abutted at the edge portion 76. In an alternative embodiment, the interface cloth layer 67 is eliminated.

In the apparatus shown in FIG. 5, the edge portion 78 is compressed so that inner and outer cloth layers 66 and 68 are juxtaposed so that the edge portions of the cloth layers may be joined by fusing at 79 or by stitching or bonding or by bonding a bead thereto or by other form of connection.

While the invention has been described with reference to specific embodiments, modifications and variations of the invention may be apparent. The scope of the invention is defined in the following claims.

We claim:

1. Personal flotation apparatus comprising a closed cell polymeric foam material having a sheet of cloth fused to the foam material using only heat and pressure having means for connecting the apparatus to the body of a wearer, the foam material having outer and inner surfaces which converge at edge portions of the foam the foam material further having curved edges, wherein the cloth material is a double-stretch material fused to at least one surface of the foam material and wherein edges of the cloth are stretched over the edge portions of the foam material and fused to the opposite surface of the foam material.

2. The personal flotation apparatus of claim 1 wherein the apparatus comprises a flotation device wherein the sheet of cloth is fused entirely to the outer surface of the foam material.

3. The personal flotation apparatus of claim 1 wherein the apparatus comprises a flotation device wherein the sheet of cloth is fused entirely to the inner surface of the foam material.

4. The personal flotation device of claim 1 wherein the cloth material is fused entirely to the outer and inner surfaces of the foam material.

5. The personal flotation apparatus of claim 1 wherein the inner layer has an inner surface and an outer surface, and the outer layer has an inner surface and an outer surface, and the sheet of cloth is fused to the outer surface of the inner layer and to the inner surface of the outer layer substantially over the entire surface thereof to provide an intermediate strengthening ply.

6. The personal flotation apparatus of claim 5 further comprising a second sheet of cloth fused to the outer surface of the outer foam material layer and extending substantially over the said outer surface.

7. The personal flotation apparatus of claim 5 further comprising a second sheet of cloth fused to the inner surface of the inner foam material layer and extending substantially over the said inner surface.

8. The personal flotation apparatus of claim 7, further comprising a third sheet of cloth fused to the outer surface of the outer foam material layer and extending substantially over the said inner surface of the inner layer.

9. The personal flotation apparatus of claim 5 further comprising a second sheet of cloth fused to the outer surface of the outer foam material layer and extending substantially over the said outer surface of the outer layer and the inner surface of the inner layer.

10. The personal flotation apparatus of claim 8 wherein the first, second and third sheet of cloth coverings have terminal edges abutting at adjacent terminal edges of the foam layers.

11. The personal flotation of claim 8 wherein the second and third sheet of cloth have terminal edge portions which overlap and which are secured together.

12. The apparatus of claim 4 where in the sheet of cloth on the outer surface and the sheet of cloth on the inner have edges which are fused together at edges of the polymeric foam material.

13. The personal flotation of claim 4 where in the sheet of cloth on the outer surface and the sheet of cloth on the inner surface have end portions which extend beyond an edge of the edges of the polymeric foam material and which end portions are overlapped and fused.

14. The apparatus of claim 1 wherein the edge portions of the foam material are rounded inwardly.

15. The apparatus of claim 14 wherein edge portions of the outer surface of the polymeric material are rounded inward and generally normally intersect edge portions of the inner surface.

16. The apparatus of claim 14 wherein a cloth covering is fused to the outer surface of the polymeric material and wherein the sheet of cloth covering extends over the rounded portion of the surface and abuts an edge of the inner surface.

17. The apparatus of claim 14 wherein edge portions of inner and outer surfaces of the polymeric material are rounded and generally intersect at a center of an edge of the foam material.

18. The apparatus of claim 14 wherein a cloth covering is fused to the outer surface of the polymeric material and wherein the cloth covering extends over the rounded portion of the surface.

19. The personal flotation apparatus of claim 1 wherein the polymeric foam material is cross linked polyethylene and where the cloth is fused to a surface of the cross linked polyethylene.

20. The personal flotation apparatus of claim 1 wherein the cloth comprises first and second layers of cloth, the first layer of cloth being connected to an outer surface of the polymeric foam material and the second layer of cloth being connected to an inner layer of the polymeric material and wherein one of the first and second of the cloth layers is permanently fused to the polymeric foam material.

21. The personal flotation apparatus of claim 1 wherein the polymeric foam material is cross linked polyethylene and where the cloth is heat fused to a surface of the cross linked polyethylene.

22. The personal flotation apparatus of claim 18 wherein the cloth material comprises is a synthetic cloth of polyester material.

23. The personal flotation apparatus of claim 18 wherein the cloth material comprises is a synthetic cloth of nylon material.

24. The personal flotation apparatus of claim 18 wherein the cloth material is a synthetic cloth of single-stretch material.

25. The personal flotation apparatus of claim 18 wherein a double-stretch cloth is mounted on one side of the foam material and a single-stretch cloth is mounted on another side of the foam material.

26. The personal flotation apparatus of claim 1 wherein the means for connecting the apparatus to the body of a wearer comprise straps passing through the foam material.

* * * * *